US010407192B2

(12) United States Patent
Schmitt et al.

(10) Patent No.: US 10,407,192 B2
(45) Date of Patent: Sep. 10, 2019

(54) STRAW FILLING DEVICE AND MACHINE COMPRISING SAME

(71) Applicant: IMV TECHNOLOGIES, Saint Ouen sur Iton (FR)

(72) Inventors: Eric Schmitt, Villaines-la-Juhel (FR); Thierry Louviot, Saint Sulpice sur Risle (FR); Christian Beau, Toussus le Noble (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 91 days.

(21) Appl. No.: 15/578,349

(22) PCT Filed: Jun. 2, 2016

(86) PCT No.: PCT/FR2016/051320

§ 371 (c)(1),
(2) Date: Nov. 30, 2017

(87) PCT Pub. No.: WO2016/193629

PCT Pub. Date: Dec. 8, 2016

(65) Prior Publication Data

US 2018/0162564 A1 Jun. 14, 2018

(30) Foreign Application Priority Data

Jun. 2, 2015 (FR) ..... 15 55021

(51) Int. Cl.

| | |
|---|---|
| ***B65B 1/16*** | (2006.01) |
| ***A61D 19/02*** | (2006.01) |
| ***B67C 3/26*** | (2006.01) |

(52) U.S. Cl.
CPC ..... *B65B 1/16* (2013.01); *A61D 19/024* (2013.01); *B67C 3/26* (2013.01)

(58) Field of Classification Search
CPC ..... B65B 1/16; B67C 3/26; A61D 19/024
See application file for complete search history.

(56) References Cited

U.S. PATENT DOCUMENTS

| | | | |
|---|---|---|---|
| 4,478,261 | A | 10/1984 | Cassou et al. |
| 5,249,610 | A | 10/1993 | Cassou et al. |

(Continued)

FOREIGN PATENT DOCUMENTS

| | | | |
|---|---|---|---|
| FR | 995878 | A | 12/1951 |
| FR | 2680101 | | 2/1993 |

(Continued)

*Primary Examiner* — Jason K Niesz
(74) *Attorney, Agent, or Firm* — Browdy and Neimark, P.L.L.C.

(57) ABSTRACT

The straw (11) filling device comprises a casing body having a cavity (43) in which the needle (9) of a nozzle (7) is placed. The needle is inserted into the straw tube (12) received in the cavity. The casing body is attached to a carriage separately from the needle. The cavity comprises a distal opening located on the distal end side of the needle, a proximal opening located on the proximal end side of the needle, and a longitudinal opening extending from the distal opening to the proximal opening, thus enabling placement and removal of the needle in and out of the cavity in a direction transverse to the direction of the needle and preventing an adult finger accessing the distal end of the needle. The machine comprises a device of this type and a conveyor (2) designed to keep the straw tube in a filling position during each cycle.

10 Claims, 4 Drawing Sheets

(56) References Cited

U.S. PATENT DOCUMENTS

| | | | |
|---|---|---|---|
| 8,464,762 | B2 | 6/2013 | Toujas et al. |
| 8,925,289 | B2 | 1/2015 | Lecointe |

FOREIGN PATENT DOCUMENTS

| | | | | |
|---|---|---|---|---|
| FR | 2758973 | A1 | 8/1998 | |
| FR | 2905592 | A1 * | 3/2008 | ..... A61D 19/024 |
| FR | 2905592 | A1 | 3/2008 | |
| FR | 2920750 | A1 | 3/2009 | |
| GB | 669265 | A | 4/1952 | |

* cited by examiner

Fig. 7
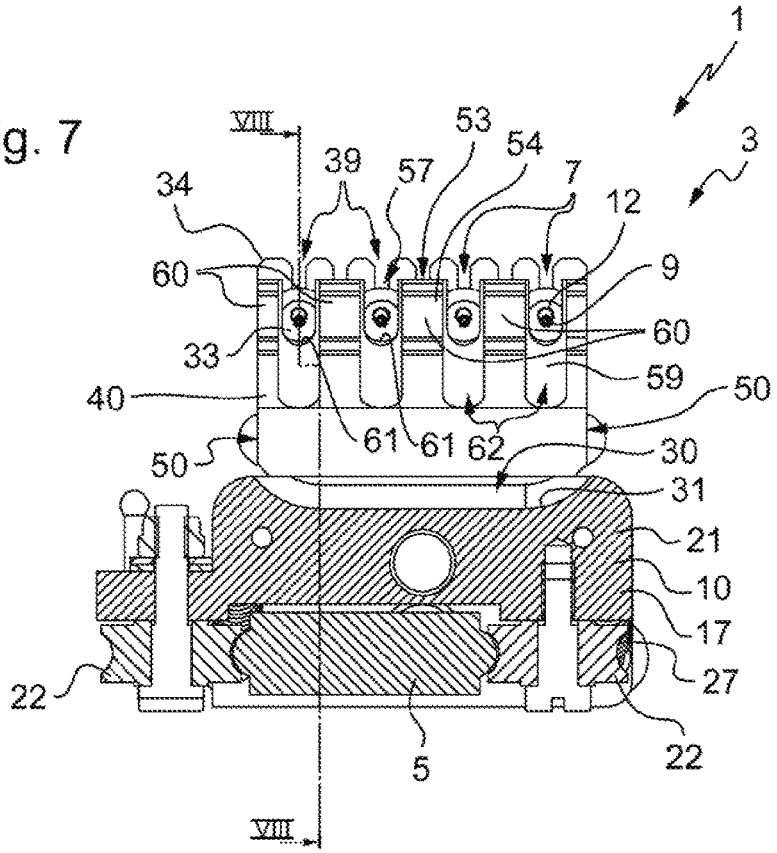
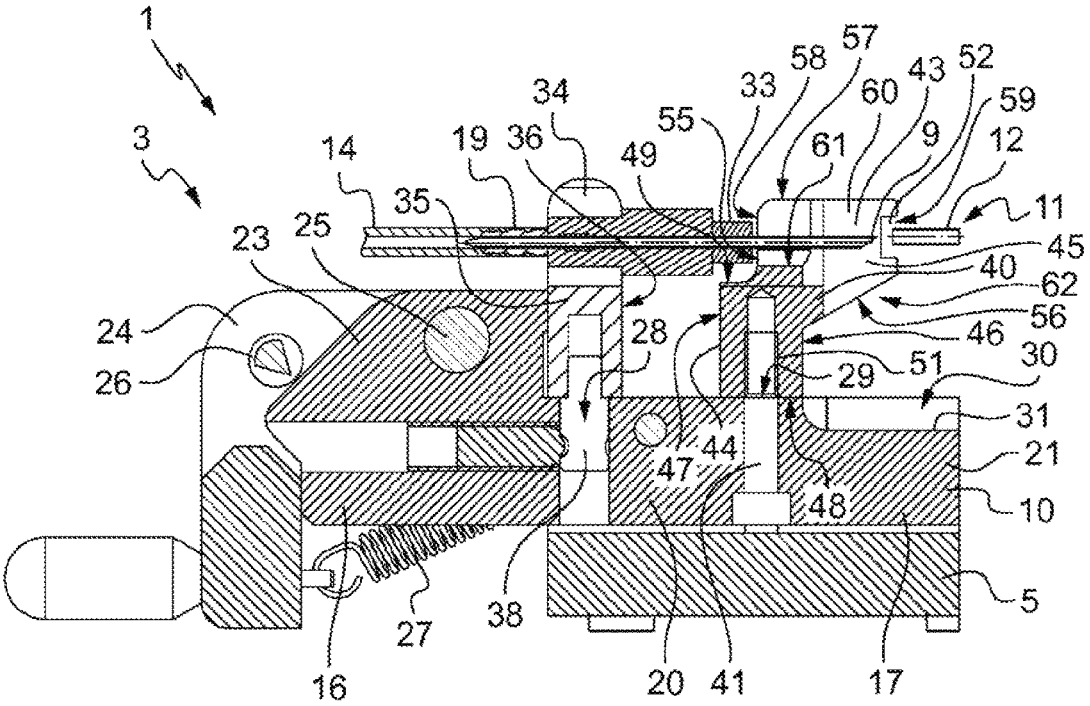
Fig. 8

STRAW FILLING DEVICE AND MACHINE COMPRISING SAME

The invention relates in general to the preservation of a predetermined dose of liquid-based substance containing biological material. Such a substance is for example diluted animal semen.

The invention more particularly concerns the filling of straws for packaging such a predetermined dose to perform such preservation.

It is known that these straws are conventionally formed by a thin tube and by a stopper engaged in the thin tube.

In general, the stoppers of straws are of the three-part type originally described in French patent 995.878, corresponding to British patent 669,265, i.e. formed by two plugs made from a fibrous substance enclosing a powder which, on contact with a liquid, transforms into an impermeable paste or gel adhering to the wall of the tube so that the stopper is liquid-tight.

FIG. 1 of the appended drawings shows a straw 11 in course of cooperating with a filling nozzle 7 and a suction nozzle 6.

The straw 11 comprises a tube 12 and a stopper 63.

The tube 12 is conventionally made from extruded plastic material, here transparent, with an inside diameter for example of 1.6 or 2.5 mm and a length of the order of 133 mm.

The stopper 63 is of the three-part type, i.e. formed by two plugs 64 and 65 made from a fibrous substance, for example braided threads, enclosing a sealing agent 66 formed by a powder which, on contact with a liquid, is capable of transforming into an impermeable paste or gel adhering to the wall of the tube 12 so that the stopper 63 is liquid-tight.

In the initial state, shown in FIG. 1, the stopper 63 is disposed in the neighborhood of the end 67 of the tube 12 and it is provided that in the filled state, the dose of liquid-based substance which must be preserved in the straw 11 is disposed between the stopper 63 and the end 68 of the tube 12 that is the furthest from the stopper 63.

To fill the straw 11, the end 67 is placed in communication, by virtue of the nozzle 6, with a vacuum source whereas the end 68 is placed in communication, by virtue of the nozzle 7, with a reservoir 69 containing the substance 70 to introduce into the tube of the straw.

The air initially contained between the stopper 63 and the end 68 is sucked through the stopper 63 while the substance 70 moves forward in the tube 12 until it encounters the stopper 63, by the end thereof that is turned towards the end 68 of the tube 12, that is to say the end of the stopper 63 that can be seen on the right in FIG. 1.

The straw 11 is then in the filled state.

If necessary, after filling, the straw is welded in the neighborhood of one or both of its ends 67 and 68 and is placed in cold storage.

To empty the straw 11, if necessary after cutting the welded end portions and thawing, there is inserted into the tube 12 a rod which comes to bear on the end of the stopper 63 situated towards the end 67.

Using this rod, the stopper 63 is made to slide in the manner of a piston towards the end 68 or the end which corresponds after cutting the welded portion, which causes the expulsion of the dose of substance 70 which had been introduced into the straw.

The filling nozzle 7 comprises a needle 9 connected to the reservoir 69 via a flexible pipe 14 connected to a connector tip 19 of the nozzle 7.

Pinching members 71 and 72 of the flexible pipe 14 enable the communication of fluid between the needle 9 and the reservoir 69 to be interrupted or allowed.

The suction nozzle 6 comprises a needle 73 connected to a vacuum source via a flexible pipe 74 connected to a connector tip 75 of the suction nozzle 6.

The filling nozzle 7 and the suction nozzle 6 are mounted on respective carriages 76 and 77 in order for each to be movable parallel to the length of the straw 11 between the advanced position illustrated in FIG. 1 and a withdrawn position.

Below, a description is made of the filling nozzle 7 but it is understood that this description also applies to the suction nozzle 6 which is similar apart from the fact that its needle is shorter.

The filling nozzle 7 comprises a body 32, a needle 9 and a plug 33.

In the advanced position, the filling nozzle 7 makes fluid-tight contact with the end 68 of the tube 12 by virtue of the plug 33.

The body 32, here generally cylindrical, is provided with a connector tip 19 to which is connected the flexible pipe 14 communicating with the reservoir 69 of substance 70.

The needle 9 is engaged in the body 32 which it passes through from the connector tip 19 until it projects from the body 32 remotely from the connector tip 19.

The needle 9 thus extends from a proximal end situated in the connector tip 19 to a distal end.

This distal end is pointed, here thanks to a beveled shape.

The plug 33 is mounted on the needle 9 at a distance from its distal end, in contact with the body 32. The plug 33 is formed here from a section of thick-walled tube made of elastomer which is fitted by force over the needle 9 until it bears on the body 32.

In the advanced position of the nozzle 7, the needle 9 is inserted into an end portion of the tube 12. In the withdrawn position of the nozzle 7, the needle 9 is out of the tube 12.

For more detail, reference may be made to French patent application 2 680 101.

The invention aims to improve the conditions of safety of use of such a filling device while maintaining its simplicity and convenience of use.

To that end, the invention provides a device for filling straws for packaging a predetermined dose of liquid-based substance, each said straw comprising a thin tube of predetermined dimensions, said device comprising a mounting for holding the tube of a straw in a predetermined filling position and a lateral assembly comprising:

- a nozzle movable between a withdrawn position and an advanced position, which is provided with a needle configured to be inserted into an end portion of the tube held in filling position when the nozzle is in advanced position, and configured to be out of the tube held in filling position when the nozzle is in withdrawn position, said needle comprising a pointed distal end; and
- a carriage on which is mounted said nozzle, to drive it between said withdrawn position and said advanced position;

characterized in that said lateral assembly comprises an encasing body having a housing in which is disposed said needle, configured to receive said end portion of the tube held in filling position in which is inserted the needle when the nozzle is in advanced position; said encasing body is fastened to the carriage independently of the needle; and the housing comprises a distal opening situated towards the distal end of the needle, a proximal opening situated towards the proximal end of the needle and a longitudinal opening extending from the distal opening to the proximal opening;

the distal opening, the proximal opening and the longitudinal opening being configured to allow the putting in place and the removal of the needle into or out of the housing in a direction transverse to the direction of the needle and to prevent a finger of an adult accessing the distal end of the needle.

Thus, the encasing body which the filling device according to the invention comprises makes it possible to avoid injuries to operators of the machine by the pointed end of the needle, the different openings of the housing being configured to prevent a finger of an adult accessing that pointed distal end of the needle.

The encasing body constitutes an obstacle for a finger of an adult, by preventing it from accessing the pointed end of the needle. On the contrary, the encasing body is not an obstacle for the common operations of changing nozzle to be carried out on the machine since the openings of the housing are configured to allow the putting in place and the removal of the needle into and from the housing in a direction transverse to the direction of the needle, that is to say in the conventional direction for changing the nozzles.

It will be noted in particular that the possibility of performing the putting in place and the removal of the needle in a direction transverse to the direction of the needle is much more convenient than if the needle had to be threaded coaxially to its direction into a tubular sleeve.

It will furthermore be noted that the encasing body provided by the present invention is much more convenient than the protective lids which must be removed when nozzle changing operations are carried out, since the encasing body according to the invention requires no intervention whereas the lid must be opened before the operations and closed afterwards. What is more, the lid may obstruct the view of the distal end of the needle, whereas the longitudinal opening of the encasing body of the device according to the invention makes it possible to see that distal end at all times.

Lastly, it will be noted that the safety problem solved by the present invention is linked to the presence of a point at the distal end of the needle; and that such a problem is not posed for the filling nozzles in which no member so pointed is provided.

For example, French patent application 2 758 973 proposes to replace the filling and suction nozzles in which the needle has a pointed end by connector tips each constituted by a body of plastic material having a conical male or female part partially surrounding a capillary tube which replaces the needle. The conical part of the body enables a straw to be clamped. The distal end of the capillary tube is straight (and not pointed) since the centering role of the nozzle in relation to the tube of the straw is played by the conical part of the connector tip.

In such a connector tip, the problems of safety solved by the present invention do not arise since there is no needle having a pointed distal end.

According to advantageous features of the device according to the invention:

said nozzle comprises, in addition to said needle, a body and a plug, the needle projecting from the body as far as the distal end of the needle, the plug being threaded over the needle and in contact with the body, said nozzle and said encasing body being configured such that in advanced position, the tube of the straw held in filling position is in contact with the plug;

the plug has a portion opposite the periphery of the proximal opening of the housing;

the nozzle comprises at the proximal end of the needle a connector tip for connection to a pipe; and the device further comprises a nozzle carrier fastened to the carriage and having a notch configured to receive a portion of a body of the nozzle situated between the connector tip and a portion of the needle projecting from the body;

the nozzle carrier is removably fastened to the carriage;

said lateral assembly comprises a plurality of said nozzles disposed side-by-side, a single said encasing body for said plurality of nozzles comprising a plurality of said housings for each to receive a said needle of a said nozzle of said plurality of nozzles;

each movable nozzle is a filling nozzle for filling the tube of a straw with said liquid-based substance; and said housing comprises a bottom wall in its lower part; and/or the device comprises, in addition to said lateral assembly, another similar assembly disposed opposite the other end of the tube of the straw held in filling position, each nozzle of said end assembly being a filling nozzle connected to a source of said liquid substance and each nozzle of the other end assembly being a suction nozzle connected to a vacuum source.

The invention is also directed to a machine comprising a device such as set out above, and a conveyor forming said mounting, which conveyor is configured to hold the tube of a straw in said predetermined filling position at each cycle.

Advantageously, said conveyor comprises at least one belt having a succession of reception housings for said straws.

The disclosure of the invention will now be continued with the detailed description of embodiments, given below by way of non-limiting illustration, with reference to the appended drawings. In these:

FIG. 1, already described, shows a straw in course of cooperating with a filling nozzle and with a suction nozzle in a prior device;

FIG. 7 is the cross-section view on VII-VII of FIG. 3; and

FIG. 8 is the cross-section view on VIII-VIII of FIG. 7.

In the following description of a filling device according to the invention, in the interest of simplicity, the same numerical references have been kept for the parts similar to those of the prior device illustrated in FIG. 1.

Figure 2:
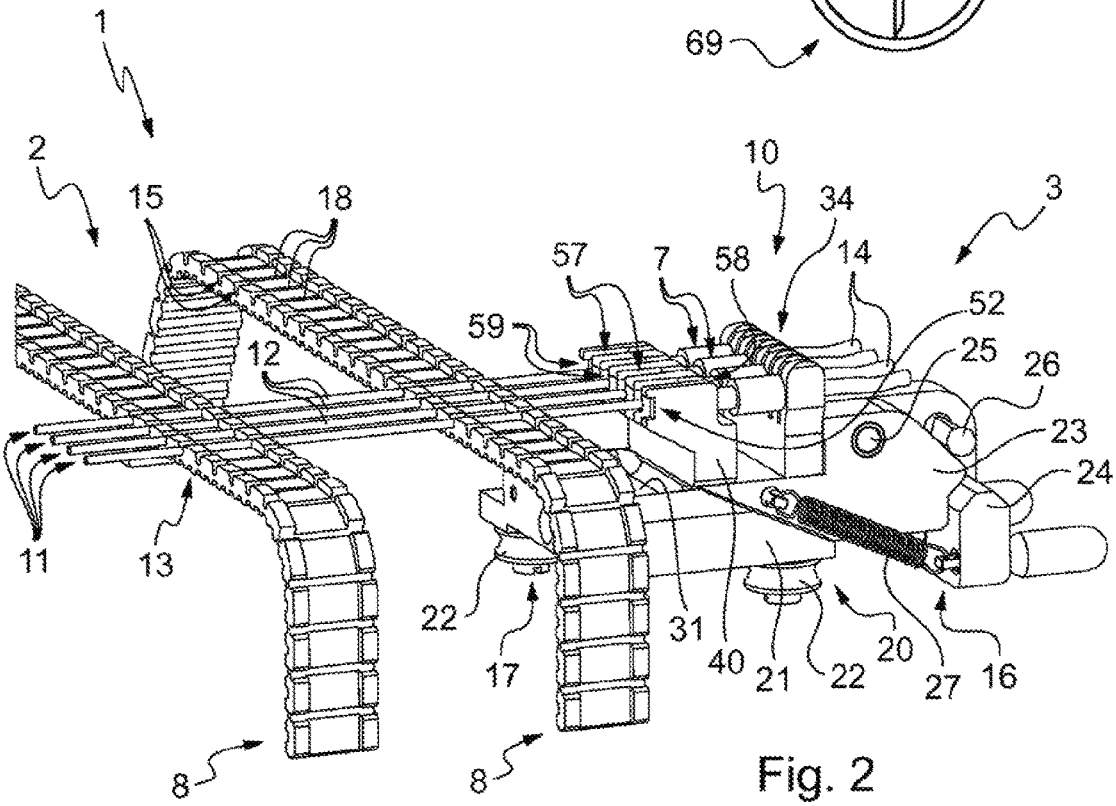
FIG. 2 is a perspective view of a device according to the invention capable of simultaneously filling four straws, there only being shown the lateral assembly situated towards where the filling takes place, the filling nozzles being in withdrawn position.

The filling device 1 illustrated in FIG. 2 et seq. form part of a filling machine comprising a conveyor 2 which transports straws 11 cyclically in order for each in turn to have its tube 12 held in a predetermined filling position.

The conveyor 2 thus participates in the filling device by forming a mounting to hold the tube 12 of the straw 11 to fill in a predetermined filling position.

Here, the filling device 1 simultaneously fills four straws 11. The mounting formed by the conveyor 2 thus simultaneously holds the tube of four straws each in a respective predetermined position.

In the interest of simplicity in the drawings, only the four straws 11 with which the filling device 1 is cooperating are illustrated, but it is understood that the conveyor 2 is loaded with other straws, which are filled if they have already cooperated with the filling device 1.

In addition to the mounting formed by the conveyor 2, the filling device 1 comprises a lateral assembly 3 disposed laterally relative to the conveyor 2.

The lateral assembly 3 comprises four filling nozzles 7 and a carriage 10 on which are mounted the filling nozzles 7.

The carriage 10 serves to make each of the filling nozzles 7 movable between a withdrawn position and an advanced position.

Figure 3:
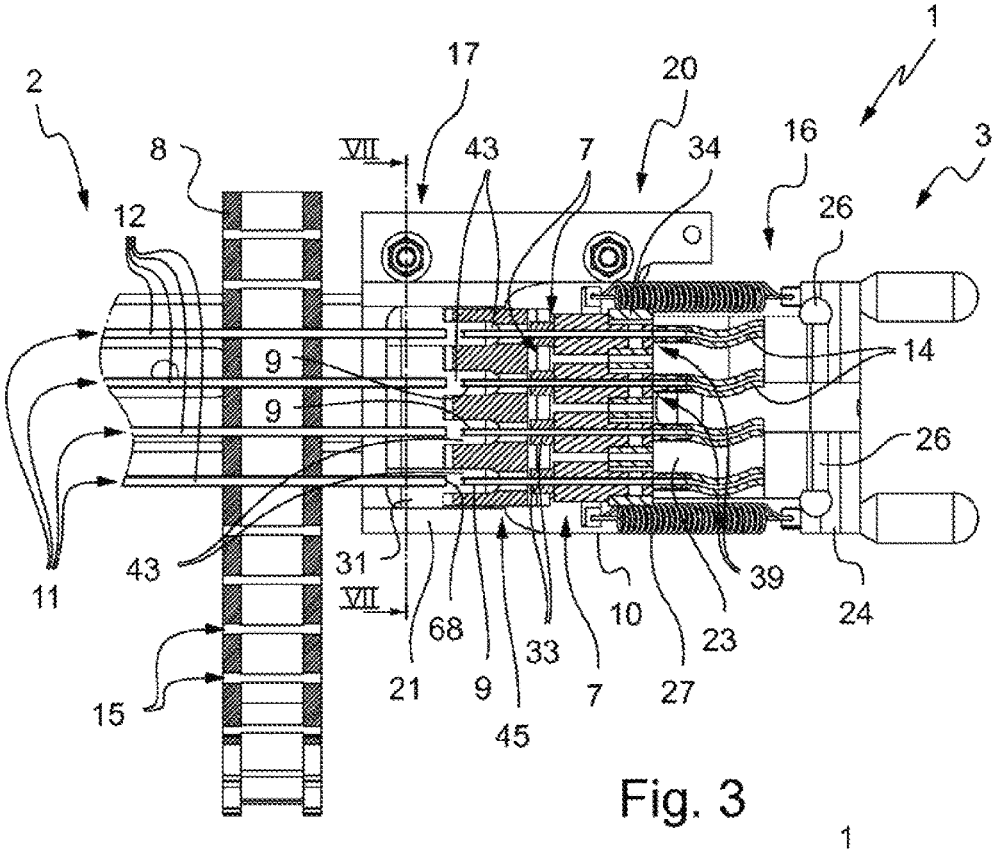
FIG. 3 is a plan view in section, taken from above, of that device according to the invention.

For each nozzle 7, when the carriage 10 is in withdrawn position (FIGS. 2, 3, 7 and 8), the needle 9 is out of the tube 12 of the straw to fill, as can be seen more particularly in FIG. 3. When the carriage 10 is in advanced position (FIGS. 4 and 5), the needle 9 is inserted into an end portion of the tube 12, as shown in FIG. 1 and as can be seen more particularly in FIG. 4.

In addition to the lateral assembly 3, the filling device 1 comprises, on the other side of the mounting formed by the conveyor 2, a similar lateral assembly not illustrated comprising four suction nozzles similar to the suction nozzles 6 and a carriage on which are mounted those four suction nozzles.

On the carriage 10 of the lateral assembly 3 of the device 1 illustrated in FIG. 2 et seq., the four filling nozzles 7 are disposed side-by-side like the tubes 12 of the four straws 11 to fill. Similarly, on the carriage of the lateral assembly situated on the other side of the mounting formed by the conveyor 2, the four suction nozzles are disposed side-by-side like the tubes 12 of the four straws 11 to fill.

Figure 1:
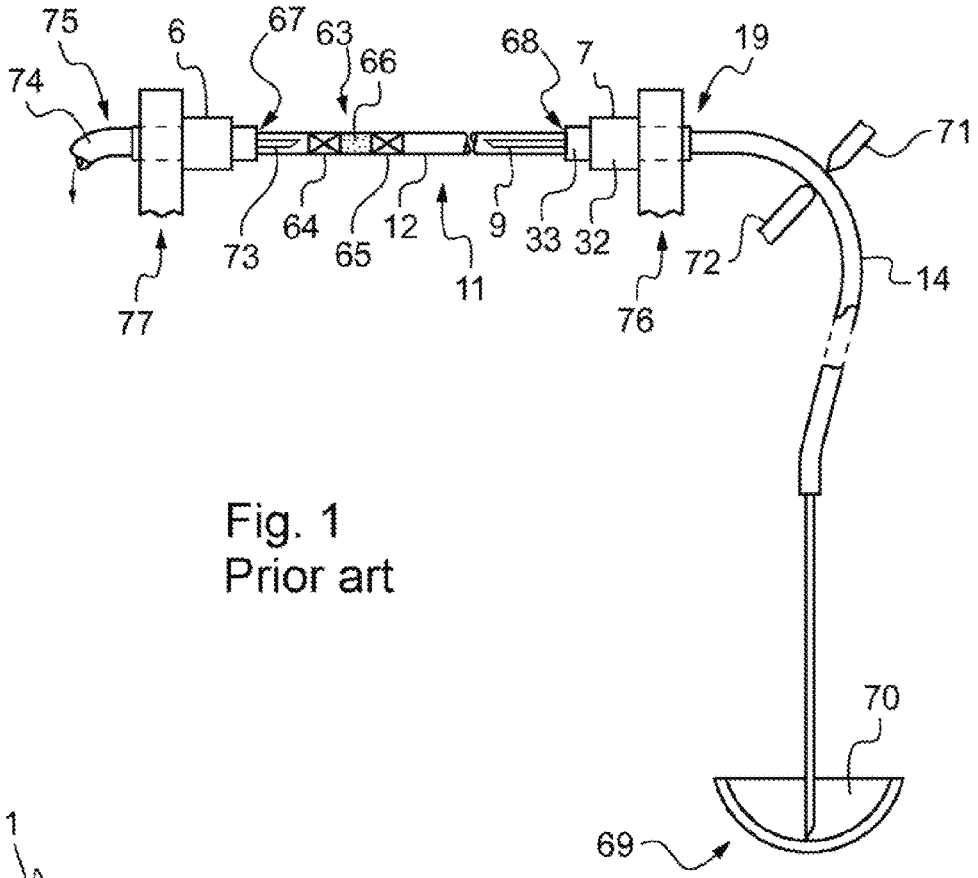
Fig. 1 Prior art

The filling of the straws 11 by the filling device 1 in accordance with the invention is carried out in the same way as with the prior filling device illustrated in FIG. 1, apart from the fact that the four straws are filled simultaneously, each by virtue of a respective pair formed by a filling nozzle 7 and a suction nozzle.

The movable carriage 10 will now be described in more detail.

The carriage 10 comprises a body 21 and wheels 22 fastened to the body 21.

The wheels 22 are configured to cooperate with a rail 5 (FIG. 7) to be guided in back-and-forth translation.

The body 21 of the movable carriage 10 has a rear part 16 situated on the opposite side of the carriage 10 to the mounting formed by the conveyor 2, a front part 17 situated towards the mounting formed by the conveyor 2 and an intermediate part 20 extending from the rear part 16 to the front part 17.

The rear part 16 comprises a fixed block 23 connected by its lower part to the intermediate part 20 and a movable block 24.

The movable block 24 extends remotely from the intermediate part 20 and is pivotally mounted on the fixed block 23 via an articulation 25 provided in the upper part of the fixed block 23.

The movable block 24 is provided with two bearing fingers 26.

The movable block 24 and the fixed block 23 are configured in order for the bearing fingers 26 to come into proximity with the fixed block 23 in a first position of the movable block 24 and in order for them to be away from the fixed block 23 in a second position of the movable block 24.

The carriage 10 further comprises two springs 27 fixed by their first end to the intermediate part 20 and by their second end to the movable block 24.

The springs 27 are configured to return the movable block 24 into its first position—that is to say the position in which the bearing fingers 26 are in proximity with the fixed block 23—when it is away therefrom.

The carriage 10 is furthermore configured such that when it approaches the mounting formed by the conveyor 2, the movable block 24 pivots so as to move the bearing fingers 26 away from the fixed block 23.

At the time of the reverse movement, the springs 27 return the movable block 24 towards the position in which the bearing fingers 26 are in proximity with the fixed block 23.

When the filling nozzles 7 are mounted on the carriage 10, flexible pipes 14 are slid between the fixed block 23 and the bearing fingers 26.

The bearing fingers 26 and the fixed block 23 here play the role of the pinching members 71 and 72 by cutting off or reestablishing the fluid communication between the needle 9 and the reservoir 69 depending on whether carriage is respectively in withdrawn position with the needle 9 out of the tube 12, or in advanced position with the needle 9 inserted into the tube 12.

In the intermediate part 20 there are formed apertures 28 and apertures 29 (see more particularly FIG. 8).

The apertures 28 are situated towards the rear part 16 of the carriage 10.

The apertures 29 are situated towards the front part 17 of the carriage 10 with the apertures 29 each being configured to receive the shank of a screw 41 (FIG. 8).

The apertures 28 and 29 open on a face of the intermediate part 20 that is situated towards the top of the carriage 10.

The carriage 10 furthermore has a recess 30 forming a bowl 31, which is provided in its front part 17.

The filling nozzles 7 are mounted on the carriage 10 via a nozzle carrier 34.

The nozzle carrier 34 comprises a body 35, of generally parallelepiped shape, which has two main faces and four lateral faces.

Figure 6:
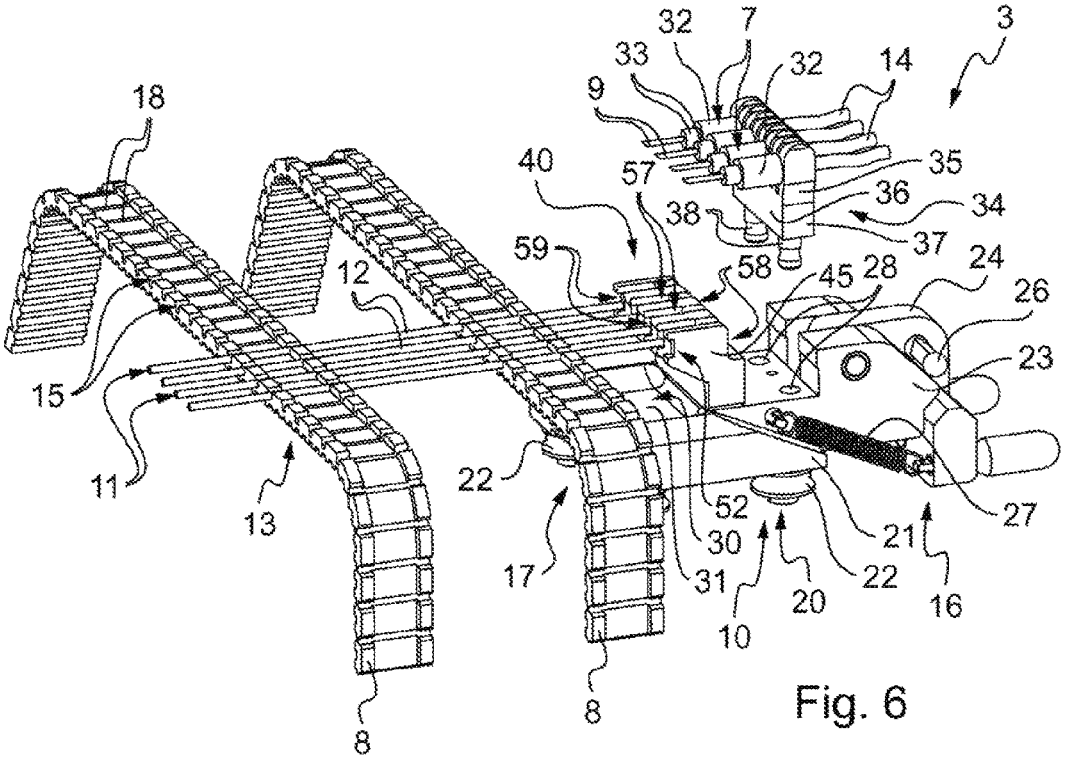
FIG. 6 is a similar view to FIG. 2, but with the nozzles out of the carriage opposite the location which they occupy therein.

In the interest of simplicity, only the main front face 36 and the left lateral face 37 are designated in the drawings (FIG. 6).

The nozzle carrier 34 is provided with two identical mounting studs 38 projecting from the body 35 from the lower lateral face of the latter.

These two studs 38 are each configured to cooperate with a respective aperture 28 provided in the intermediate part 20 of the body 21 of the carriage 10 to rigidly fasten the nozzle carrier 34 to the carriage 10 in a predetermined position.

The nozzle carrier 34 furthermore has, remotely from the studs 38, a plurality of notches 39 of a predetermined width and depth formed in the body 35.

Each notch 39 defines a housing opening onto each main face, on respective opposite sides of the body 35, and opening onto the opposite lateral face to the studs 38.

The studs 39 are regularly spaced along the body 35, with a spacing equal to the predetermined pitch with which the tubes 12 of the straws 11 are held side-by-side by the mounting formed by the conveyor 2.

The notches 39 are each configured to cooperate with a portion of the body 32 of a filling nozzle 7 so as to rigidly hold the nozzle 7.

To confer a degree of flexibility to the nozzle holder 34 enabling the insertion of a body 32 into each notch 39, a slot is formed in the material of the nozzle carrier situated between the two successive notches 39.

The filling device 1 illustrated in FIG. 2 et seq. comprises, in accordance with the invention, an encasing body 40 fastened to the carriage 10.

A housing 43 is formed in the encasing body 40 for each filling nozzle 7.

In each housing 43 is provided the needle 9 of the corresponding nozzle 7.

The encasing body 40 comprises a base 44, and a protective block 45 in which are provided the housings 43 and which is remote from the base 44.

Here, each housing 43 is channel-shaped.

The base 44 has a generally parallelepiped shape and has a front face 46, a back face 47 that is an opposite face to the front face 46, a lower face 48, and an upper face 49 that is an opposite face to the lower face 48 and two opposite lateral faces 50.

The base 44 further comprises two bores 51 opening onto the lower face 48 and which are each configured to receive the shank of a screw 41 (FIG. 8).

When the encasing body 40 is fastened to the carriage 10, the lower face 48 is in contact with the upper face of the intermediate part 20 with each bore 51 being opposite an aperture 29.

For each pair formed by a bore 51 and an aperture 29, the shank of a fastening screw 41 is screwed into the bore 51 of the encasing body 40 and engaged in the aperture 29 of the carriage 10 to fasten the encasing body 40 onto the carriage 10.

It will be noted that the encasing body 40 is fastened to the carriage 10 independently of the needles 9.

This makes it possible to mount the nozzles 7 on the carriage 10, or to demount them therefrom, while the encasing body 40 remains fastened to the carriage 10.

The protective block 45 projects from the base 44 from the upper and front faces 49 and 46.

The protective block 45 has an upper face 53 opposite to the base 44, a front face 54, a back face 55 opposite to the front face 54, a lower face 56 opposite to the upper face 53 and two lateral faces (FIGS. 7 and 8).

The upper, front and back faces 53, 54 and 55 of the protective block 45 are respectively oriented parallel to the lower, front and back faces 48, 46 and 47 of the base 44.

The lower face 56 of the block 45 connects the lower end of the front face 54 of the block 45 to the upper end of the front face 46 of the base 44 while presenting an inclination directed towards the front side and towards the upper side of the block 45.

The back face of the block 45 connects the back end of the upper face 53 of the block 45 to the front end of the upper face 49 of the base 44.

It will be observed that the front face 54 has a groove 52 extending from one to the other of the lateral faces of the block 45.

As can be seen in FIG. 8, the groove 52 enables passage of the tip of the straws 11.

Each channel-shaped housing 43 is delimited by two lateral walls 60 and a bottom wall 61 extending transversely between the lateral walls 60.

A lateral wall 60 situated between two successive housings 43 is common to these housings 43.

Each housing 43 has a longitudinal opening 57 that opens onto the upper face 53, a proximal opening 58 that opens onto the back face 55 and a distal opening 59 that opens onto the front face 54.

As can be seen in FIGS. 6 and 8, the longitudinal opening 57 extends from the distal opening 59, situated towards the distal end of the needle 9, to the proximal opening 58 situated towards the proximal end of the needle 9.

The distal opening 59, the proximal opening 58 and the longitudinal opening 57 are configured to allow the putting in place and the removal of the needle 9 into or out of the housing 43 in a direction transverse to the direction of the needle 9 and to prevent a finger of an adult accessing the distal end of the needle 9.

In this connection, the material situated on respective opposite sides of the groove 52 conveniently makes it possible to meet the standard-based requirements of safety distance relative to users' fingers.

In particular, around the point of the needle 9, the space formed by the housing 43 and the groove 52 is open to the outside through a mouth with parallel edges of which the width matches the minimum spacing between the walls 60; this mouth comprising in particular the distal opening 59 and part of the longitudinal opening 57.

Here, the width of the mouth around the point of the needle is 4 mm, the width of the groove 52 is 4 mm, and the point of the needle 9 disposed in the housing 43 is advantageously more than 2 mm away from each opening of the mouth.

These values enable the requirements of the standard ISO 13857 to be met.

Each channel-shaped housing 43 has a greater width towards its distal opening 59 than towards its proximal opening 58.

In other words, the distance between the needle 9 and the lateral walls 60 delimiting that housing 43 is greater towards the distal end of the needle 9 than towards the proximal end of the needle.

The width of each housing 43 is also always greater than the outside diameter of the tube 12 of a straw 11.

Figure 4:
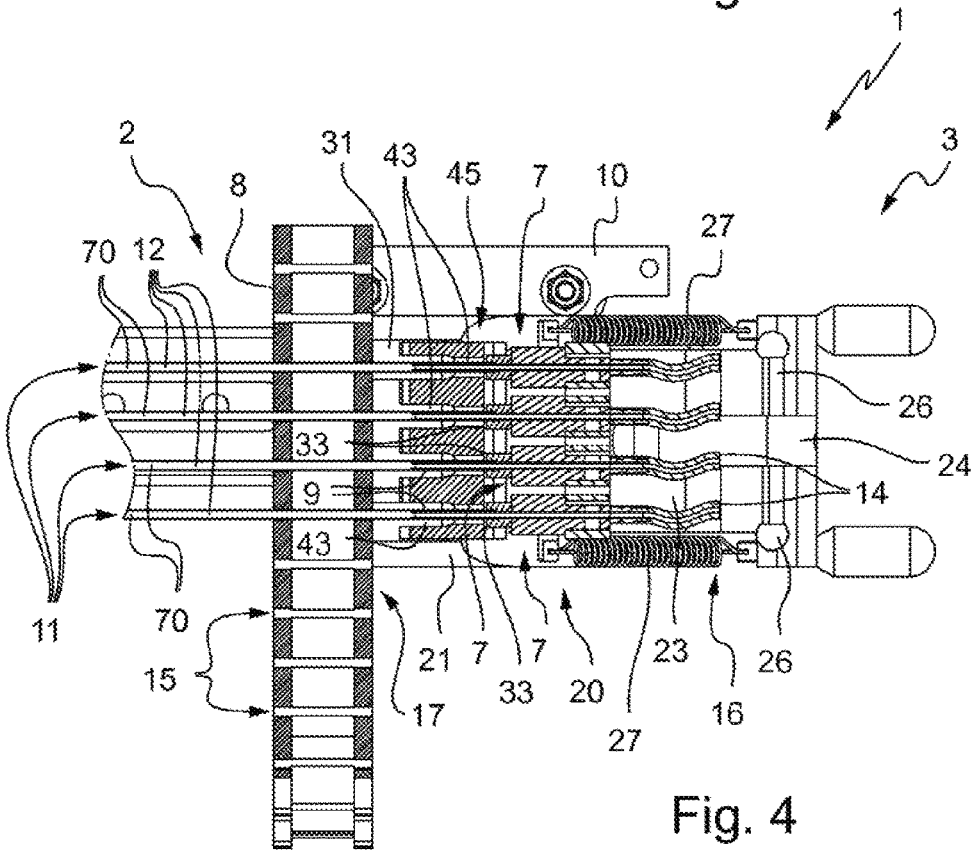
FIG. 4 is a similar view to FIG. 3 but with the nozzles in advanced position.
Figure 5:
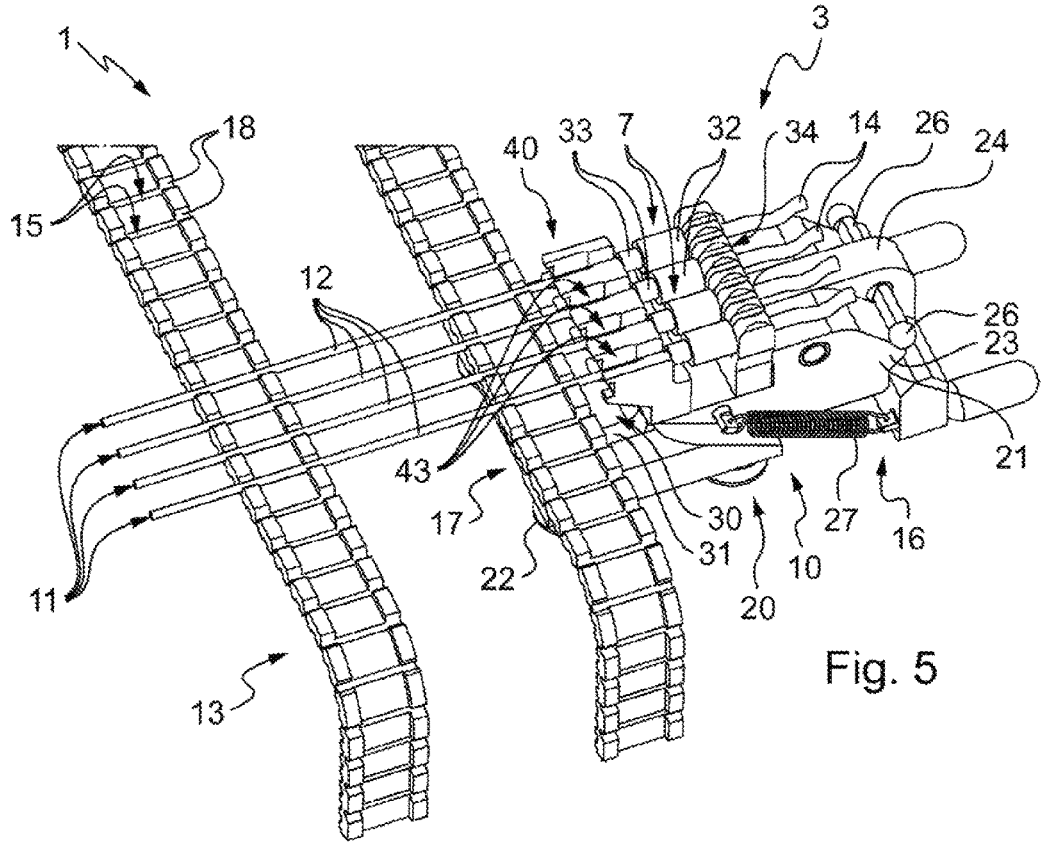
FIG. 5 is a perspective view of the device with the nozzles in advanced position.

Thus, each housing 43 can receive the end portion of the tube 12 held in filling position into which is inserted the needle 9 when the nozzle 7 is in advanced position, as can be clearly seen in FIG. 4.

The bottom wall 61 of each housing 43 has a concavity facing towards the longitudinal opening 57.

The bottom wall 61 and the lateral walls 60 each extend from the proximal opening 58 of the housing 43 towards the distal opening 59 but over a shorter length as regards the bottom wall 61, the housing 43 thus having a lower opening 62 which opens through the lower face 56.

In what follows, a description is given of the arrangement and the cooperation of the carriage 10, of the filling nozzles 7, of the nozzle carrier 34 and of the encasing body 40 with the straws 11. It is understood that this description applies for the other lateral assembly which comprises the suction nozzles, it also being provided with an encasing body for the needles of the suction nozzles.

When the encasing body 40 is fastened to the carriage 10, it is oriented with each distal opening 59 being turned towards the conveyor 2 and overhanging the front part 17 of the carriage 10, and more specifically overhanging the recess 30.

When the nozzle carrier 34 is fastened to the carriage 10 with the filling nozzles 7 mounted on the nozzle carrier 34, each portion of needle 9 which juts from the body 32 of a filling nozzle 7 is in large part received in a housing 43 of the encasing body 40.

Each needle 9 is thus surrounded on three sides: by the bottom wall 61 of the lower side and by the lateral walls 60 on its lateral sides, with the distal end of the needle 9 (which is pointed) set back relative to the longitudinal, distal and lower openings 57, 59 and 62, as can be clearly seen in FIGS. 3 and 8.

Thus, since the pointed distal end of the needle 9 does not jut out from the housing 43, while being situated at a sufficient distance from the openings 59, 57 and 62 for a finger of an adult not to be able to reach it, the risk of injury to the user and/or damage to the needles 9 is avoided or in any case greatly limited.

At the location of the distal opening 59, since the length of the bottom wall 61 is shorter than that of the lateral walls 60, the pointed distal end of the needle 9 is located both set back from the distal opening 59 and opposite the recess 30 forming the bowl 31 in the front part 17 of the carriage 10.

In this way, were drops of liquid substance 70 to escape from the pointed distal end of the needle 9, they would not fall on the bottom wall 61 but into the bowl 31, through the lower opening 62.

The plug 33 mounted on the needle 9 is disposed opposite, and almost in contact with, the back face 55 of the protective block 45.

It will be noted, as is clearly visible for example in FIG. 3, that the plug 33 has a portion opposite the periphery of the proximal opening 58, since the plug 33 is wider than the housing 43 at the location of its proximal opening 58.

As each housing 43 is wider than the tube 12 of a straw 11, the tube 12 may be disposed in the housing 43 and exit from it through the proximal opening 58.

Therefore, at the time of the approaching movement of the carriage 10 towards the straws 11 disposed in filling position, each needle 9 is inserted into an end portion of the tube 12 of a straw 11, with each end portion of the tube 12 of a straw 11 penetrating by the distal opening 59 into the housing 43 which receives that needle 9, the tube 12 of the straw 11 not entering into contact with the lateral walls 60 of the housing 43.

As explained above, on insertion of the needle 9 into the straw 11, the end 68 of the tube 12 comes to bear on the plug 33 which it compresses, which ensures fluid-tight contact.

It could occur that the plug 33 is driven with the tube 12 of the straw at the time of the withdrawal movement from the filling nozzle 7.

Given that the plug 33 has a portion opposite the periphery of the proximal opening 58, the back face 55 can act here advantageously as an abutment surface preventing the plug 33 from leaving the device 1 while being brought with a straw 11. On the contrary, the plug 33 is stopped by the back face 55 and remains on the needle 9.

It will be observed that the longitudinal opening 57 enables the user to see the needles 9, which may be useful for verifying the correct operation of the device 1.

The mounting and demounting of the nozzles 7 on the lateral assembly 3 is carried out simply by inserting or removing these latter from the nozzle carrier 34, each needle 9 being inserted or extracted through the longitudinal opening 57 of the housing 43 in which it is received.

It is also possible to demount the nozzle carrier 34 together with the nozzles 7, then afterwards remove these latter from the nozzle carrier.

To demount the encasing body 40 from the carriage 10, the nozzles 7 are first of all removed (with or without the nozzle carrier 34), and then the screws 41 are removed.

The encasing body 40 may be cleaned while out of the carriage 10 or mounted on the carriage 10, the concave profile of the bottom wall 61 of each housing 43 facilitating the cleaning.

As indicated above, the filling device 1 illustrated in FIG. 2 et seq. forms part of a machine for filling straws of which the conveyor 2 forms a mounting to hold the tube 12 of each straw 11 to fill in a predetermined filling position.

A description will now be made of the conveyor 2 and of the members of that machine with which the conveyor 2 cooperates in addition to the filling device 1.

The conveyor 2 comprises two belts 8 spaced away from each other by a distance less than the length of a straw 11 and a drive mechanism for the belts 8.

Each belt 8 has a succession of reception housings 15 for straws such as 11.

The housings 15 are disposed with a predetermined pitch.

The belts 8 cooperate with the drive mechanism by virtue of a teeth formation 13 situated remotely from the housings 15.

Each housing 15 has the shape of a channel 18 in the hollow of which is received the tube 12 of a straw 11 of the corresponding diameter.

The conveyor 2 is fed with straws 11 from a feed device comprising a hopper for storing straws to fill.

After the filling device 1, the conveyor 2 brings the filled straws to a station for welding the ends of the tubes 12.

In variants that are not illustrated:

- the filling device is provided to treat, in each cycle, a number of straws different from four, for example only one, two, or more than four; and of course, there are as many filling nozzles as straw(s) to process in each cycle and the encasing body has as many housings as there are nozzle(s).
- the mounting for holding the tube of the straw in a filling position is formed other than by a conveyor such as 2, for example a mounting in which the tube is put in place manually; and/or
- the housing or housings such as 43 of the encasing body such as 40 has a different shape, for example a groove of variable width or depth or a slot with no bottom.

Numerous other variants are possible according to circumstances, and in this connection it is to be noted that the invention is not limited to the examples described and shown.

The invention claimed is:

1. A device for filling straws (11) for packaging a predetermined dose of liquid-based substance (70), each said straw (11) comprising a thin tube (12) of predetermined dimensions, said device (1) comprising a mounting (2) for holding the tube (12) of a straw (11) in a predetermined filling position and a lateral assembly (3) comprising:

- a nozzle (7) movable between a withdrawn position and an advanced position, which is provided with a needle (9) configured to be inserted into an end portion of the tube (12) held in filling position when the nozzle (7) is in advanced position, and configured to be out of the tube (12) held in filling position when the nozzle (7) is in withdrawn position, said needle (9) comprising a pointed distal end; and
- a carriage (10) on which is mounted said nozzle (7), to drive it between said withdrawn position and said advanced position;
- characterized in that said lateral assembly (3) comprises an encasing body (40) having a housing (43) in which is disposed said needle (9), configured to receive said end portion of the tube (12) held in filling position in which is inserted the needle (9) when the nozzle (7) is in advanced position; said encasing body (40) is fastened to the carriage (10) independently of the needle (9); and the housing (43) comprises a distal opening (59) situated towards the distal end of the needle (9), a proximal opening (58) situated towards the proximal end of the needle (9) and a longitudinal opening (57) extending from the distal opening (59) to the proximal opening (58); the distal opening (59), the proximal opening (58) and the longitudinal opening (57) being configured to allow the putting in place and the removal of the needle (9) into or out of the housing (43) in a direction transverse to the direction of the needle (9) and to prevent a finger of an adult accessing the distal end of the needle (9).

2. A device according to claim 1, characterized in that said nozzle (7) comprises, in addition to said needle (9), a body (32) and a plug (33), the needle (9) projecting from the body (32) as far as the distal end of the needle (9), the plug (33) being threaded over the needle (9) and in contact with the body (32), said nozzle (7) and said encasing body (40) being configured such that in advanced position, the tube (12) of the straw (11) held in filling position is in contact with the plug (33).

3. A device according to claim 2, characterized in that the plug (33) has a portion opposite the periphery of the proximal opening (58) of the housing (43).

4. A device according to claim 1, characterized in that the nozzle (7) comprises at the proximal end of the needle (9) a connector tip (19) for connection to a pipe (14); and the device further comprises a nozzle carrier (34) fastened to the carriage (10) and having a notch (39) configured to receive a portion of a body (32) of the nozzle (7) situated between the connector tip (19) and a portion of the needle (9) projecting from the body (32).

5. A device according to claim 4, characterized in that the nozzle carrier (34) is removably fastened to the carriage (10).

6. A device according to claim 1, characterized in that said lateral assembly (3) comprises a plurality of said nozzles (7) disposed side-by-side, a single said encasing body (40) for said plurality of nozzles comprising a plurality of said housings (43) for each to receive a said needle (9) of a said nozzle (7) of said plurality of nozzles.

7. A device according to claim 1, characterized in that each movable nozzle is a filling nozzle (7) for filling the tube (12) of a straw (11) with said liquid-based substance (70); and said housing (43) comprises a bottom wall (61) in its lower part.

8. A device according to claim 1, characterized in that it comprises, in addition to said lateral assembly (3), another similar assembly disposed opposite the other end of the tube (12) of the straw (11) held in filling position, each nozzle (7) of said end assembly (3) being a filling nozzle connected to a source of said liquid substance (70) and each nozzle (6) of the other end assembly being a suction nozzle connected to a vacuum source.

9. A machine comprising a filling device according to claim 1 and a conveyor (2) forming said mounting, which conveyor (2) being configured to hold the tube (12) of a straw (11) in said predetermined filling position at each cycle.

10. A machine according to claim 9, characterized in that said conveyor (2) comprises at least one belt (8) having a succession of reception housings (15) for said straws (11).

* * * * *